US007918667B1

(12) United States Patent
Shim

(10) Patent No.: US 7,918,667 B1
(45) Date of Patent: Apr. 5, 2011

(54) ELECTRICAL WALL OUTLET WITH LED INDICATOR

(76) Inventor: Henry Hyunbo Shim, Los Angeles, CA (US)

( * ) Notice: Subject to any disclaimer, the term of this patent is extended or adjusted under 35 U.S.C. 154(b) by 0 days.

(21) Appl. No.: 12/721,284

(22) Filed: Mar. 10, 2010

(51) Int. Cl.
*H01R 13/60* (2006.01)

(52) U.S. Cl. ..... 439/39

(58) Field of Classification Search ..... 439/39, 439/78, 578, 643
See application file for complete search history.

(56) References Cited

U.S. PATENT DOCUMENTS

| | | | | |
|---|---|---|---|---|
| 5,457,600 | A * | 10/1995 | Campbell et al. | 361/643 |
| 5,596,479 | A * | 1/1997 | Campbell et al. | 361/643 |
| 2007/0275595 | A1* | 11/2007 | Hazani et al. | 439/536 |
| 2008/0086806 | A1* | 4/2008 | Shim | 4/378 |
| 2008/0227333 | A1* | 9/2008 | Hazani et al. | 439/578 |
| 2009/0261816 | A1* | 10/2009 | Shim | 324/157 |
| 2010/0035441 | A1* | 2/2010 | Rohrbach et al. | 439/39 |
| 2011/0003491 | A1* | 1/2011 | Levy et al. | 439/78 |

* cited by examiner

*Primary Examiner* — T C Patel
*Assistant Examiner* — Vladimir Imas
(74) *Attorney, Agent, or Firm* — John K. Park; Park Law Firm

(57) ABSTRACT

An electrical wall outlet comprises an insulating cover portion, LEDs, a pair of magnetic electrodes, and insulating pads. The insulating cover portion encloses outlet electrodes of the wall outlet. The one or more outlet electrodes are ferrous. The LEDs are disposed on the front surface of the insulating cover portion. The pair of magnetic electrodes are disposed on the rear surface of the insulating cover portion, extending from a pair of common terminals of the LEDs that are disposed on the insulating cover portion, toward to one of the one or more outlet electrodes of the electrical wall outlet. The pair of magnetic electrodes are flexible to bend. Also, the pair of magnetic electrodes are resilient to recover when the insulating cover portion is plucked out. The insulating pads keeps the magnetic electrodes from touching parts other than the electrodes of wall outlet.

20 Claims, 13 Drawing Sheets

ELECTRICAL WALL OUTLET WITH LED INDICATOR

BACKGROUND OF THE INVENTION

The present invention relates to an electrical wall outlet with LED indicator. More particularly, this invention relates to an electrical wall outlet with LED indicator, which makes the device visible in the dark.

Due to the fact that human can see light of a particular frequency range, darkness and therefore night has overshadowed human activities and limited the temporal and spatial ranges thereof.

The electrical wall outlet or switch with LED indicator is able to help the people in the dark in many situations.

There are many aspects in the conventional night-glow device in installing and operating.

Accordingly, a need for electrical wall outlet with LED indicator has been present for a long time considering the wide range of potential application. This invention is directed to satisfy the long-felt need.

SUMMARY OF THE INVENTION

An objective of the invention is to provide an electrical wall outlet with LED indicator.

Another object of the invention is to provide electrical wall outlet with LED indicator, which can be easily installed.

Still another object of the invention is to provide an electrical wall outlet with LED indicator, which can be easily applicable to the prior arts.

An aspect of the invention provides an electrical wall outlet with LED indicator provides a night-glow power outlet.

The electrical wall outlet comprises an insulating cover portion, a plurality of LEDs, a pair of magnetic electrodes, and a plurality of insulating pads.

The insulating cover portion is configured for enclosing one or more outlet electrodes of the electrical wall outlet. The insulating cover portion comprises a front surface and a rear surface, and the one or more outlet electrodes are ferrous.

The plurality of LEDs are disposed on the front surface of the insulating cover portion, and the plurality of LEDs are connected with one another in parallel.

The pair of magnetic electrodes are disposed on the rear surface of the insulating cover portion, extending from a pair of common terminals of the LEDs that are disposed on the insulating cover portion, toward to one of the one or more outlet electrodes of the electrical wall outlet. The pair of magnetic electrodes are flexible to bend. Also, the pair of magnetic electrodes are resilient to recover when the insulating cover portion is plucked out.

The pair of magnetic electrodes are attracted and connected electrically to the one of the one or more outlet electrodes of the electrical wall outlet on approaching the insulating cover portion over the one or more outlet electrodes of the electrical wall outlet, such that that the plurality of LEDs are powered by the wall outlet.

The plurality of insulating pads are for insulating the pair of magnetic electrodes other than one of the electrodes of the electrical wall outlet.

At least one of the one or more outlet electrodes may comprise a connecting receptacle configured for accepting one of the pair of magnetic electrodes, and the connecting receptacle may be ferrous.

Each of the pair of magnetic electrodes may comprise a contacting arm extending vertically from the rear surface of the insulating cover portion.

The contacting arm of the magnetic electrode may comprise a magnetic end.

The electrical wall outlet may further comprise a rectifying circuit for providing DC to the LEDs. The rectifying circuit may comprise a diode and a resistor.

The electrical wall outlet may further comprise a photo resistor sensor for sensing ambient light and turning on and off the LEDs.

Another aspect of the invention provides an electrical wall outlet comprising, instead of LEDs, a plurality of neon lamps disposed on the front surface of the insulating cover portion, wherein the plurality of neon lamps are connected with one another in parallel.

The electrical wall outlet may further comprise a control circuit for controlling operation of the neon lamps. The control circuit may be configured to control operation time of the neon lamps.

The electrical wall outlet may further comprise, but not limited to, a photo resistor sensor for sensing ambient light and turning on and off the neon lamps.

Still another aspect of the invention provides an electrical switch comprising an insulating cover portion configured for enclosing terminals of the electrical switch, wherein the insulating cover portion comprises a front surface and a rear surface, and wherein the terminals are ferrous. The other features are almost same as the embodiments of electrical wall outlet.

In certain embodiments of the invention, the LEDs are powered only when the electrical switch is off.

In still another aspect of the invention, a integrated circuit disposed on the front surface of the insulating cover portion may be used instead of the LEDs.

The integrated circuit may further comprise a motion sensor for detecting motion around the electrical wall outlet and activating the LEDs, LED digital clock, or neon lamp or another light emitting integrated circuits.

Each of the pair of magnetic electrodes may comprise a contacting arm extending vertically from the rear surface of the insulating cover portion, and the contacting arm of the magnetic electrode may comprise one or more magnetic ends. The contacting arm may comprise a metal rod, plate, or spring, which is very flexible to respond to magnetic force.

The advantages of the present invention are: (1) the electrical wall outlet with LED indicator helps people using a plurality of devices in the dark; (2) the electrical wall outlet with LED indicator is easy to install; (3) the electrical wall outlet with LED indicator is applicable to the prior arts with minimal change.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 7:
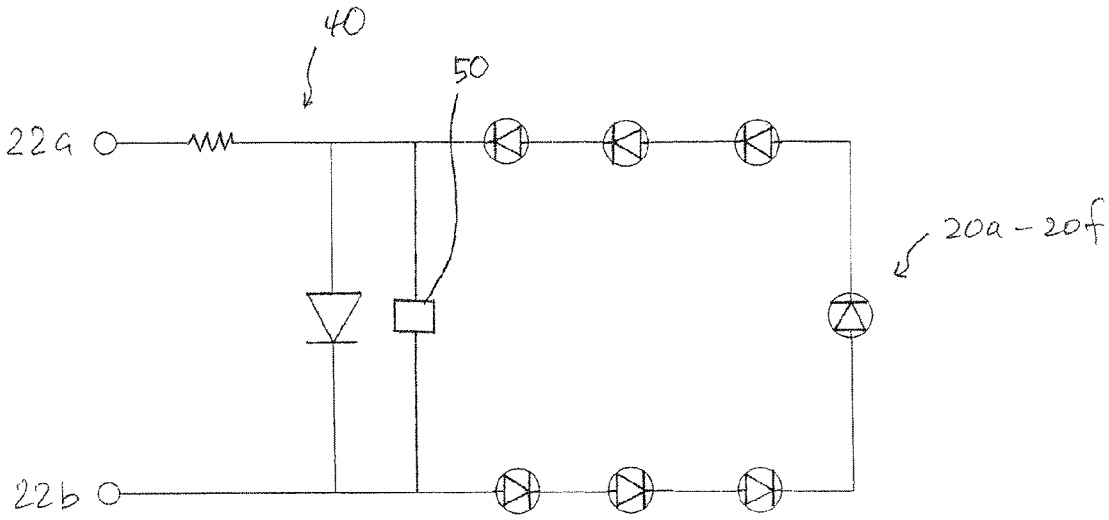
FIG. 7 is a circuit diagram for an electrical wall outlet with a photo resistor sensor according to still another embodiment of the invention.
Figure 8:
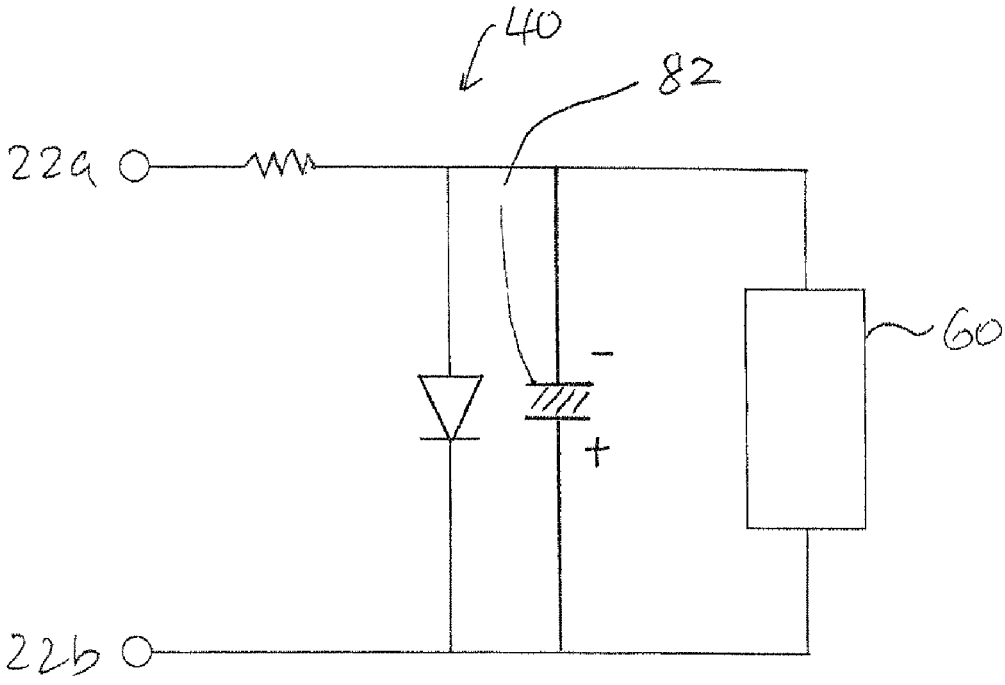
FIG. 8 is a circuit diagram for an electrical wall outlet with an integrated circuit with light emitting device according to still another embodiment of the invention.
Figure 9:
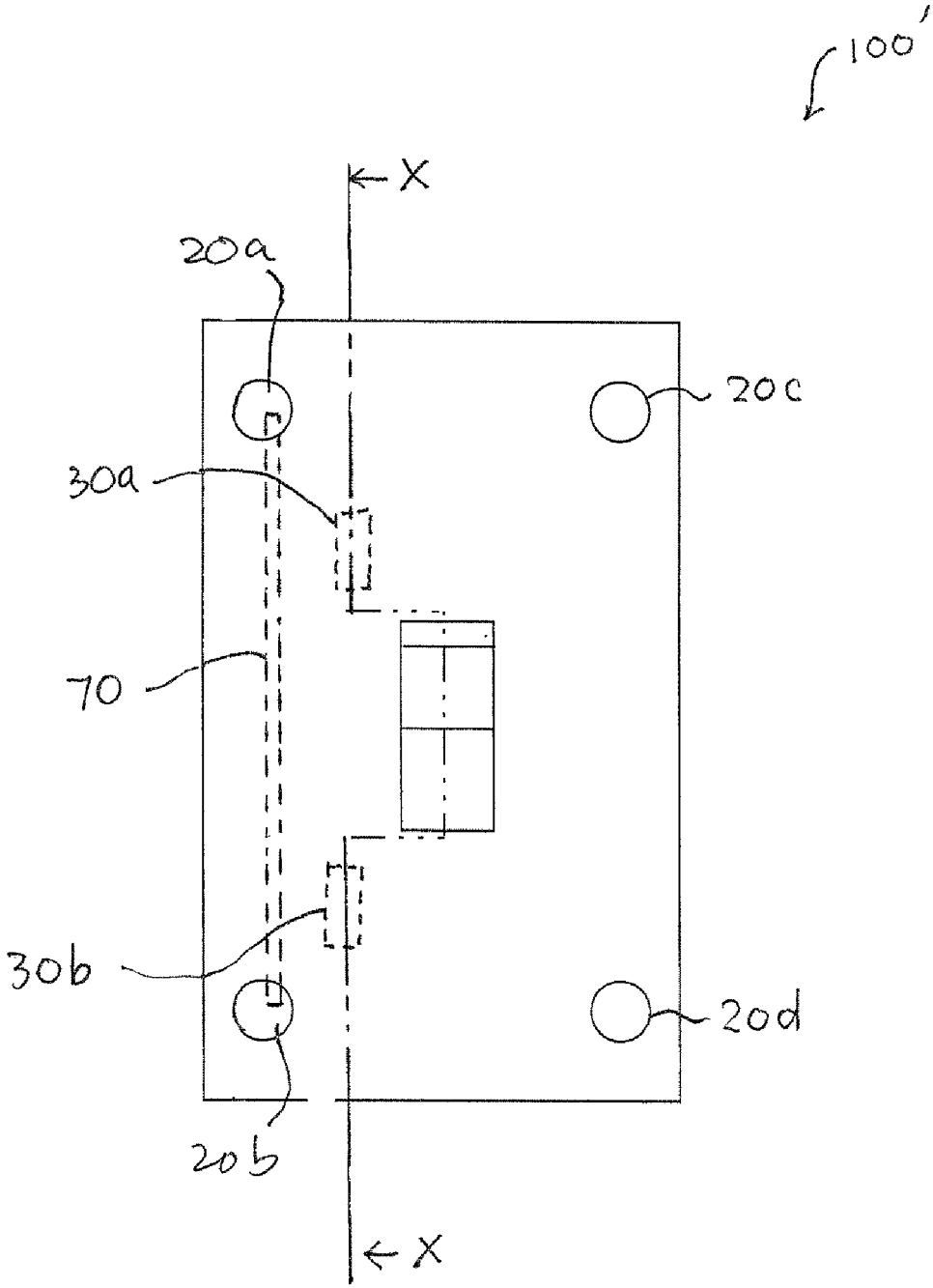
FIG. 9 is a perspective front view of an electrical switch according to another embodiment of the invention.
Figure 10:
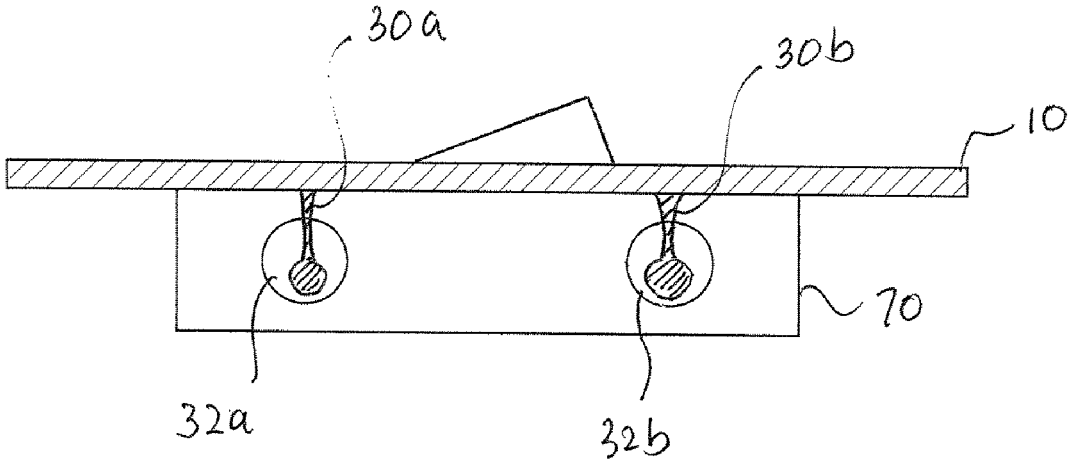
FIG. 10 is a cross-sectional view along the line X-X of FIG. 9.
Figure 11:
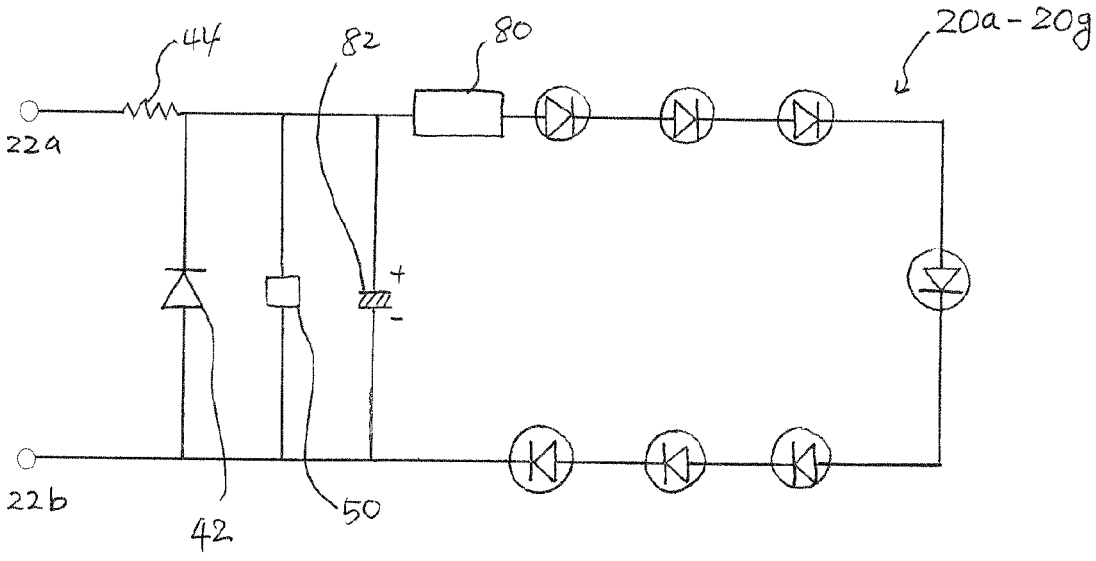
FIG. 11 is a circuit diagram for an electrical wall outlet with LED indicators in series according another embodiment of the invention.
Figure 12:
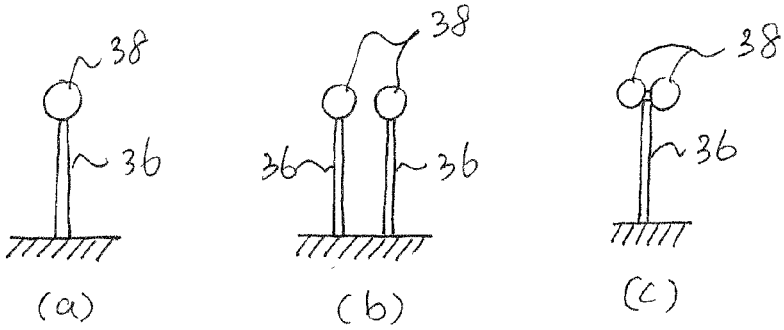
FIGS. 12(*a*)-(*c*) show magnetic electrodes according to an embodiment of the invention.
Figure 13:
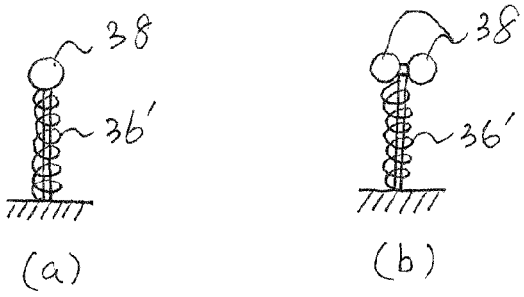
FIGS. 13(*a*)-(*b*) show magnetic electrodes according to another embodiment of the invention.
Figure 14:
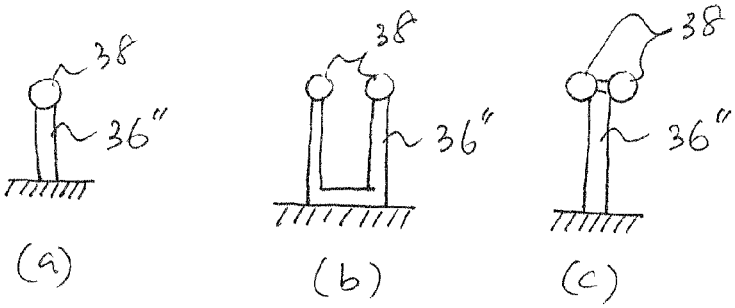
FIGS. 14(*a*)-(*c*) show magnetic electrodes according to still another embodiment of the invention.

FIGS. 1-8 show electrical wall outlets according to embodiments of the invention, and FIGS. 9-11 show an electrical switch.

An aspect of the invention provides an electrical wall outlet 100 with LED indicator provides a night-glow power outlet.

Referring to FIGS. 1-4, the electrical wall outlet 100 comprises an insulating cover portion 10, a plurality of LEDs 20*a*-20*f*, a pair of magnetic electrodes 30*a*, 30*b*, and a plurality of insulating pads 70.

Figure 1:
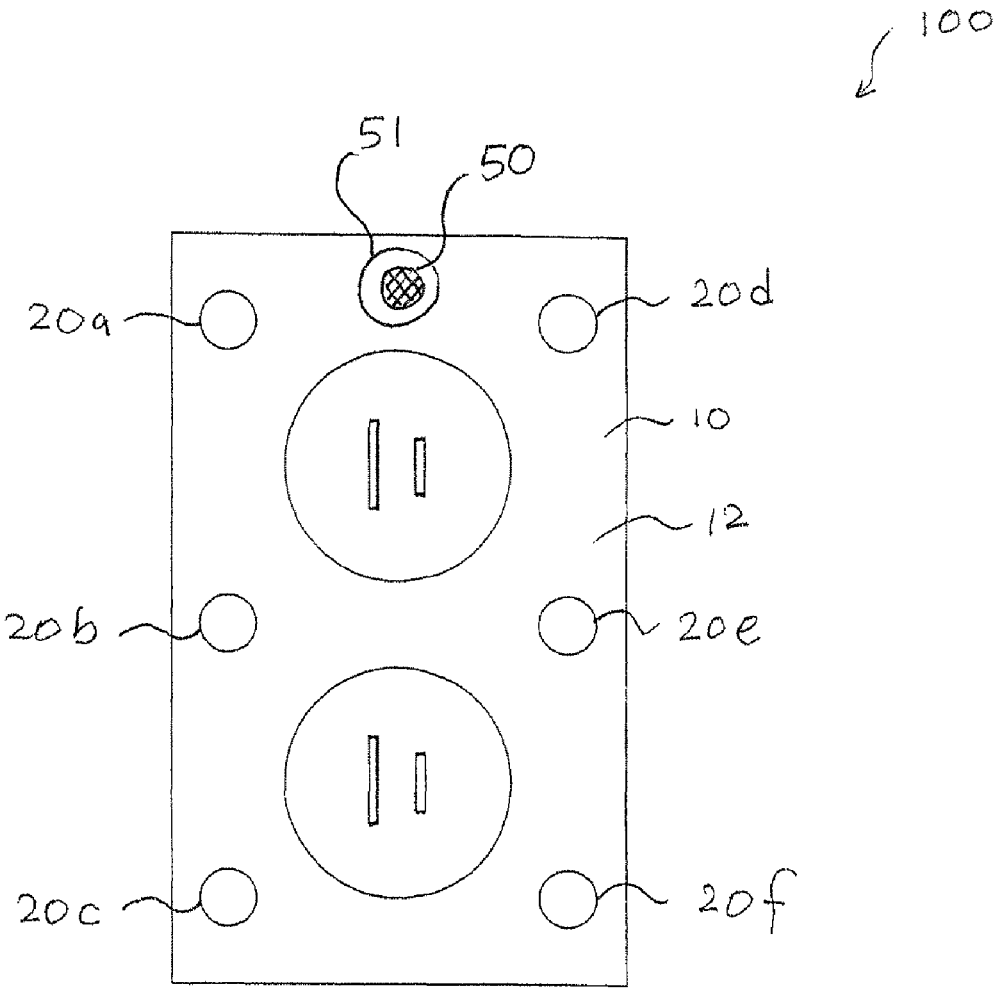
FIG. 1 is a perspective front view of an electrical wall outlet according to an embodiment of the invention.
Figure 2:
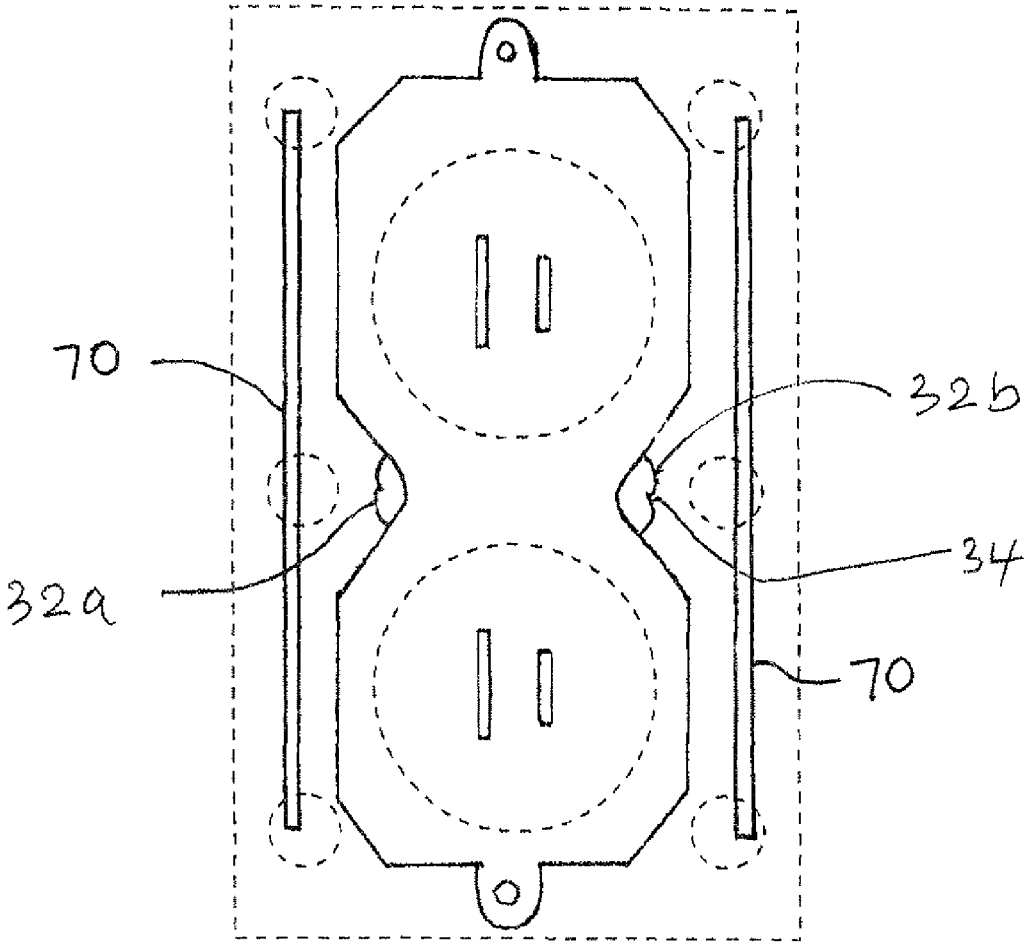
FIG. 2 is a perspective front view of the electrical wall outlet of FIG. 1.
Figure 3:
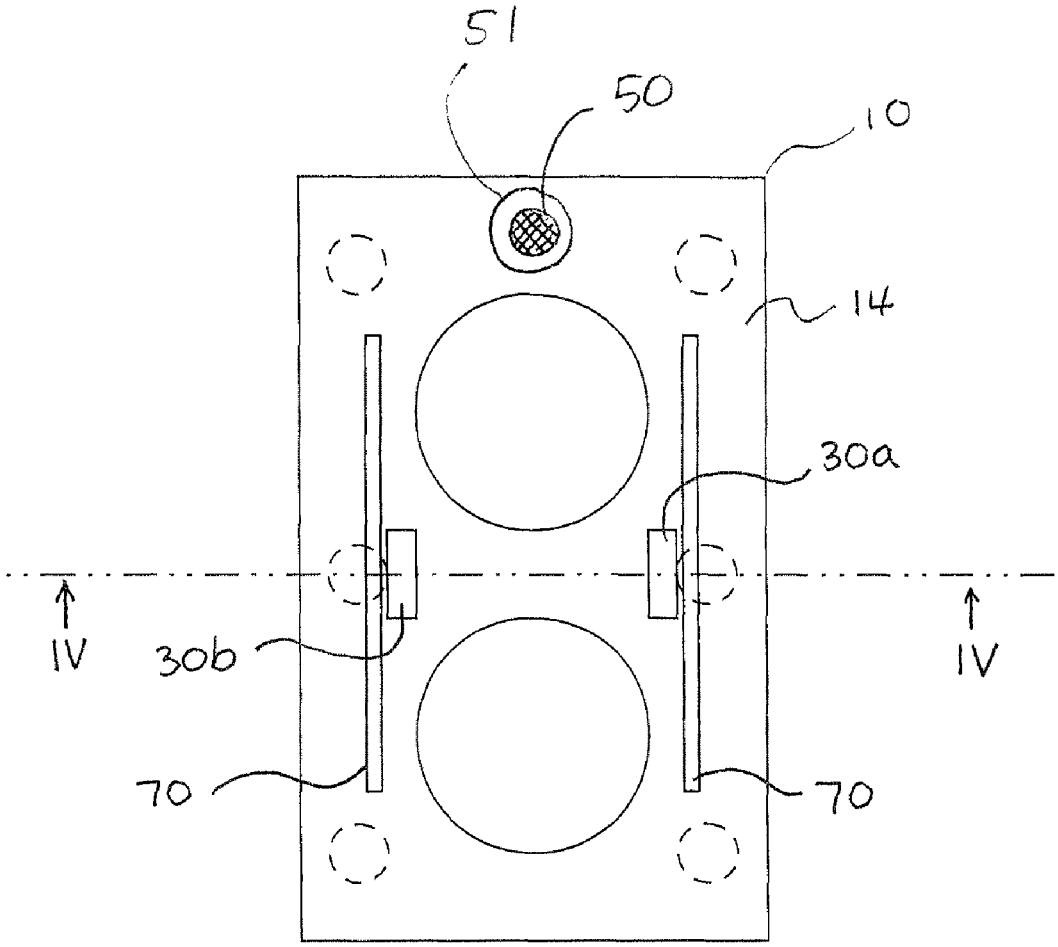
FIG. 3 is a perspective rear view of the electrical wall outlet of FIG. 1.

The insulating cover portion 10 is configured for enclosing one or more outlet electrodes 32*a*, 32*b* of the electrical wall outlet 100 as shown in FIG. 2. The insulating cover portion 10 comprises a front surface 12 and a rear surface 14, and the one or more outlet electrodes 32*a*, 32*b* are ferrous. The plurality of insulating pads are for insulating the pair of magnetic electrodes other than one of the electrodes of the electrical wall outlet.

The plurality of LEDs 20*a*-20*f* are disposed on the front surface 12 of the insulating cover portion 10, and the plurality of LEDs 20*a*-20*f* are connected with one another in parallel.

The pair of magnetic electrodes 30*a*, 30*b* are disposed on the rear surface 14 of the insulating cover portion 10, extending from a pair of common terminals 22*a*, 22*b* of the LEDs 20*a*-20*f* that are disposed on the insulating cover portion 10, toward to one of the one or more outlet electrodes 32*a*, 32*b* of the electrical wall outlet. The pair of magnetic electrodes 30*a*, 30*b* are flexible to bend. Also, the pair of magnetic electrodes 30*a*, 30*b* are resilient to recover when the insulating cover portion 10 is plucked out.

The pair of magnetic electrodes 30*a*, 30*b* are attracted and connected electrically to the one of the one or more outlet electrodes 32*a*, 32*b* of the electrical wall outlet on approaching the insulating cover portion 10 over the one or more outlet electrodes 32*a*, 32*b* of the electrical wall outlet, such that that the plurality of LEDs 20*a*-20*f* are powered by the wall outlet.

At least one of the one or more outlet electrodes 32*a*, 32*b* may comprise a connecting receptacle 34 configured for accepting one of the pair of magnetic electrodes 30*a*, 30*b*, as shown in FIG. 2, and the connecting receptacle 34 may be ferrous. In certain embodiments, the connecting receptacle 34 may be formed as a groove adapted to accept the pair of magnetic electrodes 30*a*, 30*b* as shown in FIG. 2, which may add a mechanically accepting function in addition to magnetic attraction.

Figure 4:
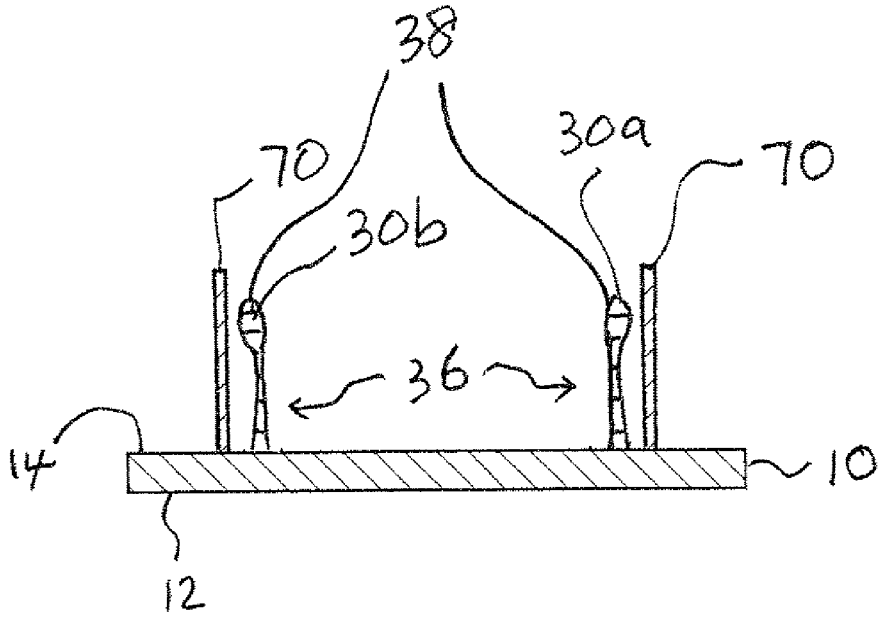
FIG. 4 is a cross-sectional view along the line IV-IV in FIG. 3, illustrating magnetic electrodes according to an embodiment of the invention.
Figure 5:
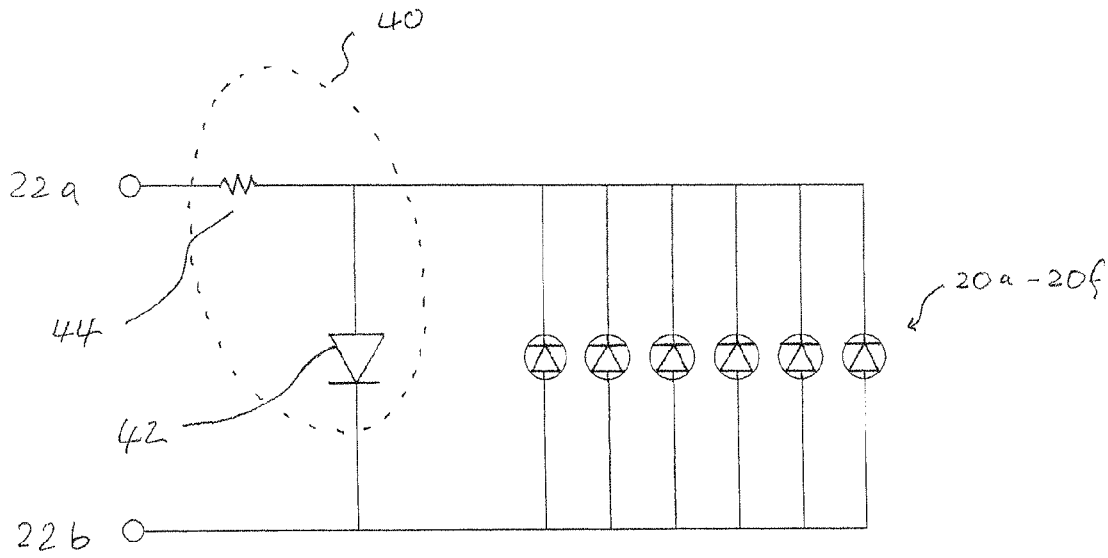
FIG. 5 is a circuit diagram for an electrical wall outlet with LED indicators according an embodiment of the invention.
Figure 6:
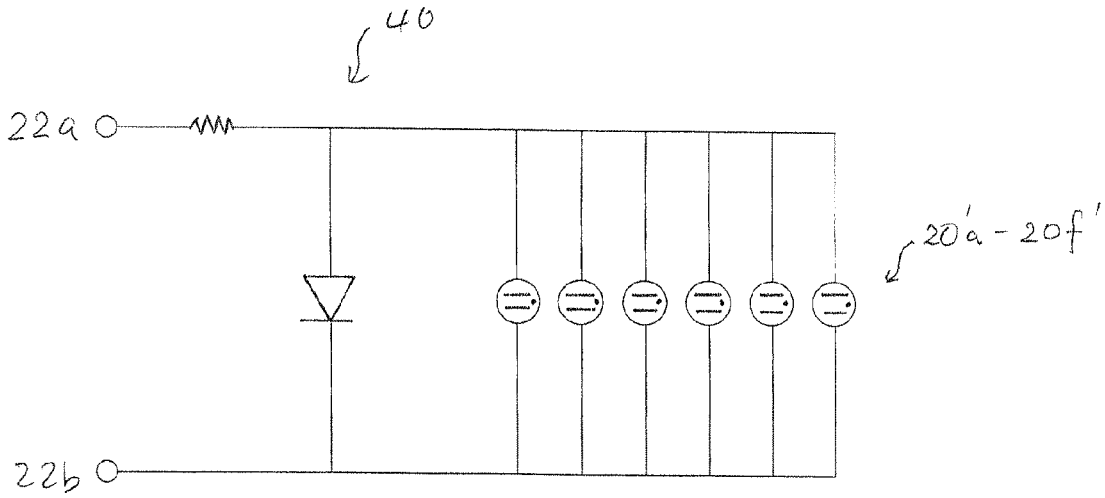
FIG. 6 is a circuit diagram for an electrical wall outlet with neon lamps according another embodiment of the invention.

Each of the pair of magnetic electrodes 30*a*, 30*b* may comprise a contacting arm 36 extending vertically from the rear surface of the insulating cover portion 10 as shown in FIG. 4.

The contacting arm 36 of the magnetic electrode 30*a*, 30*b* may comprise a magnetic end 38 of various types as shown in FIGS. 12-15. That is, the whole contacting arm 36 may not be magnetic, but only a portion, for example, a head portion of it may comprise a magnet or magnetized portion.

The electrical wall outlet 100 may further comprise a rectifying circuit 40 for providing DC to and related protection against surge for the LEDs 20*a*-20*f* as shown in FIGS. 5-8. The rectifying circuit 40 may comprise a diode 42 and a resistor 44. However, in certain embodiments, the rectifying circuit 40 may comprise other electrical component or technology. The rectifying circuit 40 may be disposed on the rear surface 14 of the insulating cover portion 10. Alternatively, the rectifying circuit 40 may be embedded in the insulating cover portion 10. The LEDs 20*a*-20*f* also may be embedded in the insulating cover portion 10.

The electrical wall outlet 100 may further comprise a photo resistor sensor 50 for sensing ambient light and turning on and off the LEDs 20*a*-20*f* as shown in FIG. 7. That is, when the ambient illumination is above a predetermined magnitude, the night glow system may be inactivated. In certain embodiments, the photo resistor sensor 50 may comprise a lens covering the photo resistor sensor 50 for facilitating the sensing as in FIG. 1.

Another aspect of the invention provides an electrical wall outlet 100 comprising, instead of LEDs 20*a*-20*f*, a plurality of neon lamps 20*a*'-20*f*' disposed on the front surface 12 of the insulating cover portion 10, wherein the plurality of neon lamps 20*a*'-20*f*' are connected with one another in parallel.

The electrical wall outlet 100 may further comprise a photo resistor sensor 50 for sensing ambient light and turning on and off the neon lamps 20*a*'-20*f*' as shown in FIG. 7.

Still another aspect of the invention provides an electrical switch 100' comprising an insulating cover portion 10 configured for enclosing terminals of the electrical switch 100', wherein the insulating cover portion 10 comprises a front surface 12 and a rear surface 14 as shown in FIGS. 9-10. The other features including the LEDs 20*a*-20*d*, magnetic electrodes 30*a*, 30*b*, outlet electrodes 32*a*, 32*b*, connecting receptacle 34, and contacting arm 36 are almost same as the embodiments of electrical wall outlet 100.

In certain embodiments of the invention, the LEDs 20*a*-20*f* are powered only when the electrical switch 100' is off.

In still another aspect of the invention, a integrated circuit 60 disposed on the front surface 12 of the insulating cover portion 10 may be used instead of the LEDs 20*a*-20*f* as shown in FIG. 8. The integrated circuit 60 comprises an LED digital clock or other devices such as ICs, which can provides illumination around the wall outlet or switch in the dark. Also, in certain embodiments, the integrated circuit 60 may comprise additional control circuit (not shown) for controlling operation of the digital clock and other conventional functions.

The electrical wall outlet or switch 100, 100' according to the invention is very easy to apply to the conventional wall outlet or switch 100, 100'. It can be done just by replacing the conventional cover portion with one according to the invention. This wall outlet and switch can be applicable irrespective of 110V system.

The resistor 44 of the rectifying circuit 42 may be configured in order to provide 16V DC to the LEDs. For the neon lamps, the resistor 44 may be configured to provide 30V AC including ripples. However, the voltage can be adjusted to specification of the circuit elements.

The diode 42 may comprise a regular AC rectifier diode, and protects the circuits from surge.

The LEDs 20*a*-20*f* may comprise SMD-LED and REG-LED according to color, voltage current ratings, shapes, etc.

The neon lamps 20*a*'-20*f*' may comprise NE-2 type or any other types of neon lamps.

The photo resistor 50 may provide a resistance of at least 1001M for the maximum, and at least 500Ω for LEDs for turning off the indicators.

However, all these values for resistors, LEDs, diodes, neon lamps, photo resistors may be changed and optimized for different design spec of the problem to solve.

The number or location of the LEDs, neon lamps, an ICs may be adapted to necessity or situations. In certain embodiments, the LEDs or neon lamps may be provided as a form of print circuit. Alternatively, they may be provided as a block combined with the diode 42 and the resistor 44.

The electrical connections can be accommodated to details of design without leaving the inventive points of the invention.

In certain embodiments of the invention, the LED indicators 20*a*-20*g* may be connected in series as shown in FIGS. 7 and 11.

Figure 16:
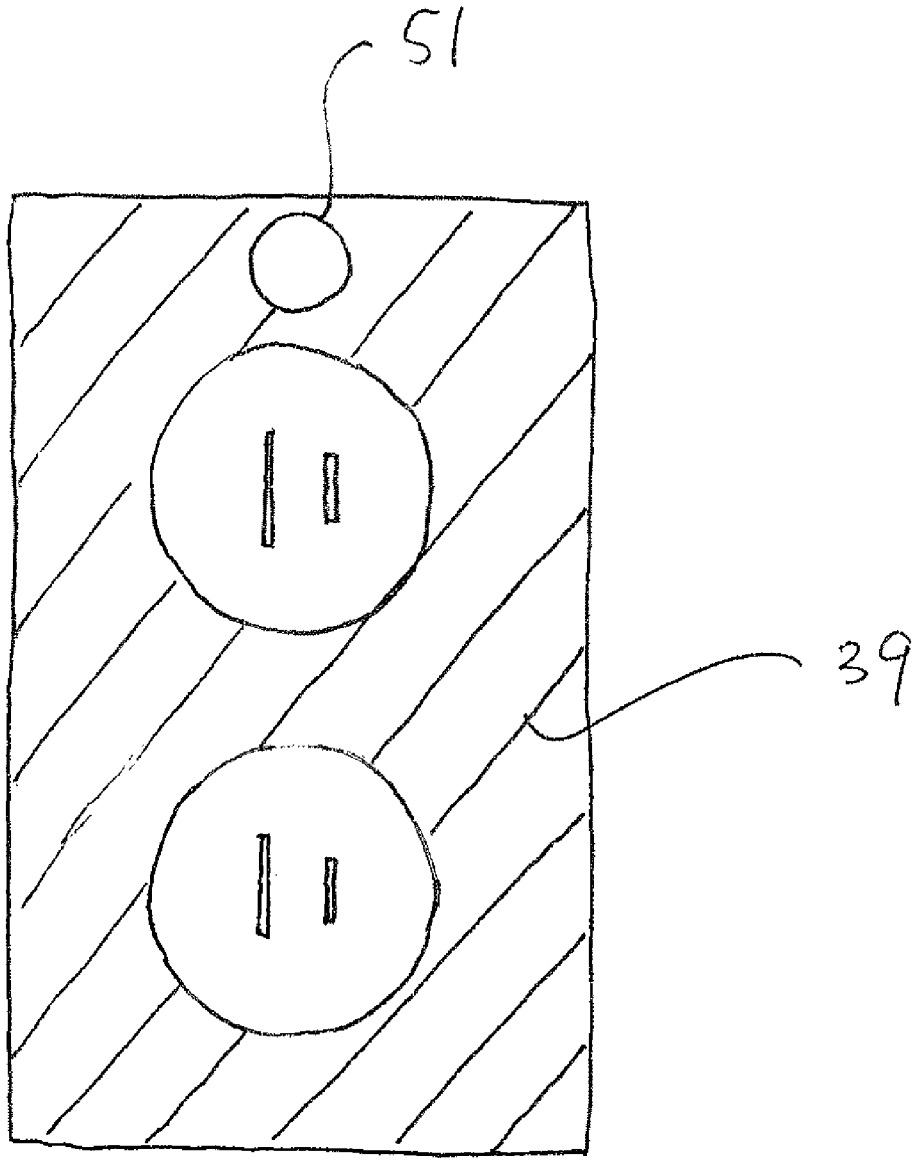
FIG. 16 shows a plan view of light disperser according to an embodiment of the invention.

The LEDs and the light sensors can be determined to optimize the entire circuit. The resistor 44 may have resistance such as 18.5KO, 27.5KO, 36.5KO, 500.5KO, etc. However, according to certain embodiments, the light sensors can be omitted, and can be replaced with a photo resistor, diode, transistor, and other proper devices. Also, the LEDs can be covered with a sort of lens to facilitate dispersion of the light from the LEDs. The lens may cover the entire area as shown in FIG. 16. The lens 39 may be a light disperser comprising a plurality of mesh of grooves.

The light sensor 50 may be omitted from the circuit.

The insulating pads 70 may comprise a piece of paper, plastic, or any other insulating plates.

In certain embodiments of the invention, the magnetic electrodes 30*a*, 30*b* may be coated by insulating film except for a small area for contacting the wall outlet electrodes.

As shown in FIGS. 2-4 and 9-10, the insulating pads 70 are not limited to the illustrated ones. The shape, dimension, material, and locations can be determined according to the inner structure of the wall outlet. In any cases, the insulating pads 70 are for preventing unintended touching of hot parts.

The number or location of LEDs may be determined by necessity.

The light sensor 50 may be plucked out from the circuit conveniently.

Even some of the LEDs may be plucked out of the circuit without giving any operational difficulty, especially when the LEDs are connected in parallel.

In still further embodiments of the invention, the electrical wall outlet 100 may further comprise reflecting lines or surfaces around the LEDs for facilitating the effect.

The embodiment shown in FIG. 8 may further comprise a photo resistor 50 and a capacitor 82 as shown in FIG. 11. The value of the capacitor can be chosen appropriately for optimal operation.

In the embodiment illustrated in FIG. 8, the electrical wall outlet 100 according to the invention may further comprise an integrated circuit 80 as shown in FIG. 11.

In the embodiments illustrated in FIGS. 8 and 11, the integrated circuit 60, 80 may further comprise a motion sensor for detecting motion around the electrical wall outlet and activating the LED digital clock or LEDs, or still another type of light emitting devices.

Figure 15:
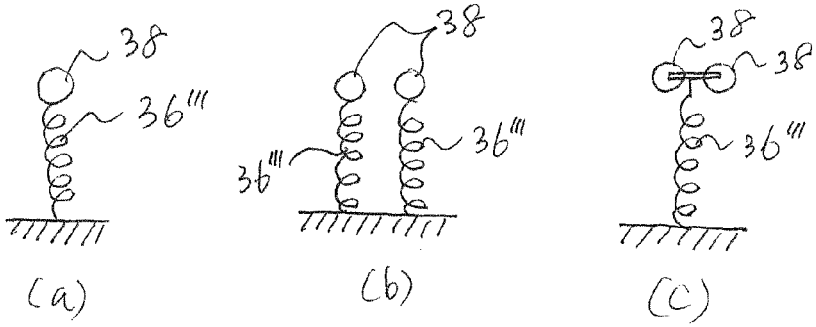
FIGS. 15(*a*)-(*c*) show magnetic electrodes according to still another embodiment of the invention.

In certain embodiment shown in FIGS. 12-15, each of the pair of magnetic electrodes 30*a*, 30*b* may comprise a contacting arm 36 extending vertically from the rear surface of the insulating cover portion, and the contacting arm 36 of the magnetic electrode 30*a*, 30*b* may comprise one or more magnetic ends 38. The contacting arm 36 may comprise one or more metal rods with or without springs (FIGS. 12 and 13), one or more metal plates (FIG. 14), and one or more springs (FIG. 15). In certain embodiments, the contacting arm 36 may comprise an insulating tube around it (not shown). And further, the contacting arm 36 may comprise a metal rod, plate, spring, etc. as shown in FIGS. 12-15.

The magnetic ends 38 of the magnet electrodes 30*a*, 30*b* may have a shape of circle, rectangle, and triangle. In the illustrated embodiments, the magnet electrodes 30*a*, 30*b* are of a shape of circle of about 0.6 mm in diameter.

The number and shape of the magnet electrodes 30*a*, 30*b* are determined by the outlet and the switch. The location of the magnet electrodes 30*a*, 30*b* may be determined by structure of the outlet and the switch. They can be installed in one side or in both side of the switch.

In certain embodiment of the invention, the magnet electrodes 30*a*, 30*b* may have a contacting arm 36, which comprises copper wire (with or without spring), elastic copper plate, spring, etc.

And, the light sensor may further comprise another one or more light sensors for detecting the environment light and controlling the operation of the LED indicator.

In certain embodiments of the invention, the insulating pads 70 may be disposed slightly leaning toward or away from the wall outlet electrodes.

In FIG. 9, another insulating pads 70 can be disposed in the right ride for facilitating the general insulation concern. Or, with one of the magnet electrodes 30*a*, 30*b* can be moved to the right side, the another insulating pads 70 can be used to insulate the moved electrode.

The light sensor 50 may be connected to the remaining circuit in parallel or serial connections.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. An electrical wall outlet comprising:

an insulating cover portion configured for enclosing one or more outlet electrodes of the electrical wall outlet, wherein the insulating cover portion comprises a front surface and a rear surface, and wherein the one or more outlet electrodes are ferrous;

a plurality of LEDs disposed on the front surface of the insulating cover portion, wherein the plurality of LEDs are connected with one another in parallel;

a pair of magnetic electrodes disposed on the rear surface of the insulating cover portion, extending from a pair of common terminals of the LEDs that are disposed on the insulating cover portion, toward to one of the one or more outlet electrodes of the electrical wall outlet; and a plurality of insulating pads for insulating the pair of magnetic electrodes other than one of the electrodes of the electrical wall outlet, wherein the pair of magnetic electrodes are attracted and connected electrically to the one of the one or more outlet electrodes of the electrical wall outlet on approaching the insulating cover portion over the one or more outlet electrodes of the electrical wall outlet, such that that the plurality of LEDs are powered by the wall outlet.

2. The electrical wall outlet of claim 1, wherein at least one of the one or more outlet electrodes comprises a connecting receptacle configured for accepting one of the pair of magnetic electrodes, wherein the connecting receptacle is ferrous.

3. The electrical wall outlet of claim 2, wherein each of the pair of magnetic electrodes comprises a contacting arm extending vertically from the rear surface of the insulating cover portion.

4. The electrical wall outlet of claim 3, wherein the contacting arm of the magnetic electrode comprises a magnetic end.

5. The electrical wall outlet of claim 1, further comprising a rectifying circuit for providing DC to the LEDs.

6. The electrical wall outlet of claim 5, wherein the rectifying circuit comprises a diode and a resistor.

7. The electrical wall outlet of claim 1, wherein the pair of magnetic electrodes are flexible to bend.

8. The electrical wall outlet of claim 7, wherein the pair of magnetic electrodes are resilient to recover on plucking out the insulating cover portion.

9. The electrical wall outlet of claim 8, further comprising a photo resistor sensor for sensing ambient light and turning on and off the LEDs.

10. An electrical wall outlet comprising:

an insulating cover portion configured for enclosing one or more outlet electrodes of the electrical wall outlet, wherein the insulating cover portion comprises a front surface and a rear surface, and wherein the one or more outlet electrodes are ferrous;

a plurality of neon lamps disposed on the front surface of the insulating cover portion, wherein the plurality of neon lamps are connected with one another in parallel;

a pair of magnetic electrodes disposed on the rear surface of the insulating cover portion, extending from a pair of common terminals of the neon lamps that are disposed on the insulating cover portion, toward to one of the one or more outlet electrodes of the electrical wall outlet, wherein the pair of magnetic electrodes are flexible to bend; and a plurality of insulating pads for insulating the pair of magnetic electrodes other than one of the electrodes of the electrical wall outlet, wherein the pair of magnetic electrodes are attracted and connected electrically to the one of the one or more outlet electrodes of the electrical wall outlet on approaching the insulating cover portion over the one or more outlet electrodes of the electrical wall outlet, such that that the plurality of neon lamps are powered by the wall outlet.

11. The electrical wall outlet of claim 10, wherein the pair of magnetic electrodes are flexible to bend.

12. The electrical wall outlet of claim 11, wherein the pair of magnetic electrodes are resilient to recover on plucking out the insulating cover portion.

13. The electrical wall outlet of claim 10, further comprising a photo resistor sensor for sensing ambient light and turning on and off the neon lamps.

14. An electrical switch comprising:

an insulating cover portion configured for enclosing terminals of the electrical switch, wherein the insulating cover portion comprises a front surface and a rear surface, and wherein the terminals are ferrous;

a plurality of LEDs disposed on the front surface of the insulating cover portion, wherein the plurality of LEDs are connected with one another in parallel;

a pair of magnetic electrodes disposed on the rear surface of the insulating cover portion, extending from a pair of common terminals of the LEDs that are disposed on the insulating cover portion, toward to one of wall outlet electrodes, wherein the pair of magnetic electrodes are flexible to bend; and a plurality of insulating pads for insulating the pair of magnetic electrodes other than one of the electrodes of the electrical wall outlet, wherein the pair of magnetic electrodes are attracted and connected electrically to the one of the wall outlet electrodes on approaching the insulating cover portion over the terminals of the electrical switch, such that that the plurality of LEDs are powered by the switch, wherein the LEDs are powered only when the electrical switch is off.

15. The electrical switch of claim 14, wherein at least one of the terminals comprises a connecting receptacle configured for accepting one of the pair of magnetic electrodes, wherein the connecting receptacle is ferrous.

16. The electrical switch of claim 15, wherein each of the pair of magnetic electrodes comprises a contacting arm extending vertically from the rear surface of the insulating cover portion, wherein the contacting arm of the magnetic electrode comprises a magnetic end.

17. An electrical wall outlet comprising:

an insulating cover portion configured for enclosing one or more outlet electrodes of the electrical wall outlet, wherein the insulating cover portion comprises a front surface and a rear surface, and wherein the one or more outlet electrodes are ferrous;

a integrated circuit disposed on the front surface of the insulating cover portion, wherein the integrated circuit comprises an LED digital clock;

a pair of magnetic electrodes disposed on the rear surface of the insulating cover portion, extending from a pair of power input terminals of the integrated circuit, toward to one of the one or more outlet electrodes of the electrical wall outlet; and a plurality of insulating pads for insulating the pair of magnetic electrodes other than one of the electrodes of the electrical wall outlet, wherein the pair of magnetic electrodes are attracted and connected electrically to the one of the one or more outlet electrodes of the electrical wall outlet on approaching the insulating cover portion over the one or more outlet electrodes of the electrical wall outlet, such that that the plurality of LEDs and the integrated circuit are powered by the wall outlet.

18. The electrical wall outlet of claim 17, wherein the integrated circuit further comprises a motion sensor for detecting motion around the electrical wall outlet and activating the LEDs.

19. The electrical wall outlet of claim 17, wherein each of the pair of magnetic electrodes comprises a contacting arm extending vertically from the rear surface of the insulating cover portion, wherein the contacting arm of the magnetic electrode comprises one or more magnetic ends.

20. The electrical wall outlet of claim 19, wherein the contacting arm comprises a metal plate and a spring.

* * * * *